US005372565A

United States Patent [19]

Burdenko

[11] Patent Number: 5,372,565

[45] Date of Patent: Dec. 13, 1994

[54] UNIVERSAL EXERCISE DEVICE

[75] Inventor: Igor Burdenko, Wayland, Mass.

[73] Assignee: Igor N. Burdenko, Wayland, Mass.

[21] Appl. No.: 156,587

[22] Filed: Nov. 23, 1993

[51] Int. Cl.[5] ..... A63B 21/02

[52] U.S. Cl. ..... 482/124; 482/55; 482/125; 482/126

[58] Field of Search ..... 482/55, 124, 125, 126, 482/121, 122, 123; 441/108, 110, 112, 113, 114, 115, 117, 119

[56] References Cited

U.S. PATENT DOCUMENTS

| | | | |
|---|---|---|---|
| 1,862,070 | 6/1932 | Summerson | 441/110 |
| 3,815,904 | 6/1974 | Weiss et al. | 482/123 |
| 4,722,523 | 2/1988 | Yang | 482/126 |
| 5,000,710 | 3/1991 | Bedoctha et al. | 441/113 |
| 5,176,600 | 1/1993 | Wilkinson | 482/124 |
| 5,186,701 | 2/1993 | Wilkinson | 482/124 |
| 5,207,635 | 5/1993 | Richards et al. | 482/124 |

*Primary Examiner*—Richard J. Apley
*Assistant Examiner*—Lynne A. Reichard

[57] ABSTRACT

A universal exercise machine comprising a belt portion (20), which is to be fixed as a conventional belt to the waist of the user. The belt portion (20) has on its upper and lower sides rings (40–56) for the attachment of elastic straps (22–30) which are connected to the hands, legs, and head of the user, for various exercises based on the application of force required for the stretching of the elastic straps. A distinguishing feature of the machine is the provision of an integrated back support (64), which may comprise a portion of the belt, or a part connected to the belt portion. The back support has a transverse rigidity greater than the remaining part of the belt portion (20). Another unique feature of the machine is the provision of floating elements (78a, 78b, . . . 78n) which imparts to the user buoyancy for exercising in the water.

6 Claims, 7 Drawing Sheets

UNIVERSAL EXERCISE DEVICE

BACKGROUND

1. Field of the Invention

The present invention relates to the field of sports, particularly to a universal exercising device suitable for physical exercising, general fitness, injury prevention, physical rehabilitation, and for similar use on land and in the water.

2. History of the Problem

Known equipment which is used for exercising in the field of physical fitness, physical training, aerobic conditioning, and weight lifting is either overly simplistic (such as a barbell, stair step, exercise stick, or jump rope), or very complicated, cumbersome, expensive, and difficult to use (such as the Nautilus apparatus, treadmill, Nordic Track, Soloflex, stationary bicycle, et cetera).

Previous attempts have been made to solve the above problems by utilizing simple devices for exercise. These devices come in the form of a special suit or belt which is attached to the user's waist, and is equipped with elastic straps, with one end of each strap being secured at the belt, while the free ends of the straps are engageable with the user's hands and legs.

One such known device is disclosed in U.S. Pat. No. 5,137,272, issued in August of 1992 to W. Wilkinson. This device is intended for use while walking. It consists of a back foundation plate to which a belt with two ends is attached. The back foundation plate has a plurality of flanges for the attachment of an extension pole, the end of which is connected to a plurality of elastic straps. One pair of these straps can be connected to the user's ankles and another pair to the user's hands.

Because of its corset design, this device is very restrictive and limits movement and flexibility. It only works while the user is moving forward and cannot be used when the user is standing, walking, running, jumping, lying down, sitting, swimming, or engaging in other forms of general exercise.

Another essential disadvantage of the device of U.S. Pat. No. 5,137,272 is that it has a rigid and possibly dangerous attachment to the corset behind the spine. It is unnecessarily complicated to adjust, and would be uncomfortable and potentially dangerous to wear and use, as it is designed for dynamic use only. The recommended cord attachment is physiologically dangerous, as the cord is attached in such a way that it would be extremely easy for the user to slip and/or trip on the cord while using the device. The attachment which is used to connect the elastic straps creates tremendous force and pressure on the ankle joints and wrists, which will cause strains and certain dislocations. The design undermines balance and is generally awkward, complicated, difficult to understand and learn how to use. The device does not protect the user from the possibility of back injury and is not recommended for rehabilitation.

Another belt-type exercise device is described in U.S. Pat. No. 5,186,701, issued in February, 1993, to W. Wilkinson. This is an aerobic resistance exercise garment which requires a cumbersome body suit as an integral part of the system. Any exercise suit device restricts the range of motion in the joints as well as in the body, and creates an environment where the body can become overheated, losing the opportunity of breathing through the skin. This approach requires many sizes, incurs great costs, and results in a device which not everyone can wear.

Furthermore, the flexible cords are fastened at the wrong positions on the front of the belt, making the cords uncomfortable and cumbersome to use, and thereby interfering with the utility of device. This device's attachments are also highly complicated, creating unnecessary pressure and tension on the joints, as described previously.

Thus, as has been shown above, both approaches (i.e., known exercising suits and belts) are overly complicated and expensive with no apparent safety features. Neither can be used in water easily or capable of strengthening of neck muscles and provide an integrated back support.

OBJECT AND ADVANTAGES OF THE INVENTION

It is therefore an object of the invention to eliminate the above disadvantages and to provide an improved universal exercise device which provides unrestricted freedom of movement and flexibility; allows the user's movement in any direction; can be used whether the user is lying down, sitting, standing, walking, jogging, running, jumping, swimming, water walking and running (in zero gravity environment), and exercising in any kind of sport activity; is free of a potentially dangerous attachments; is physiologically advantageous for the user's body; is simple in construction; is, moreover, simple and inexpensive to manufacture, easy to adjust, highly portable, and applicable to various exercises both on land and in the water.

SUMMARY OF THE INVENTION

The universal exercise machine comprises a belt portion, which is to be fixed as a conventional belt to the waist of the user. The belt portion has on its upper and lower sides rings for the attachment of elastic straps which are connected to the hands, legs and head of the user for various exercises, based on the application of forces required for the stretching of the elastic straps. A distinguishing feature of the machine is the provision of a back support which may comprise a portion of the belt or a part connected to the belt portion. The integrated back support prevents back injury and lessens chronic back pain. The back support has a transverse rigidity greater than the remaining part of the belt portion. Another unique feature of the machine is the provision of a floating element which imparts buoyancy to the user, should he or she wish to exercise in the water.

BRIEF DESCRIPTION OF THE DRAWINGS

FIGS. 1–8. DETAILED DESCRIPTION OF THE UNIVERSAL EXERCISE DEVICE

FIG. 1 is a general view of the universal exercise device of the invention, as worn by a person, with bands connected to the legs, hands, and head.

In general, the device consists mainly of a belt portion 20 which is attached to the waist of the user A as a conventional belt, and of interchangeable and elastic straps 22, 24, 26, 28, and 29. Although five such straps are shown, i.e., straps 22 and 26 which are attached to the user's legs, straps 24 and 28 which are attached to the user's hands, and strap 29 which is attached to the user's head, the number of straps can be less than or more than five.

Figure 1:
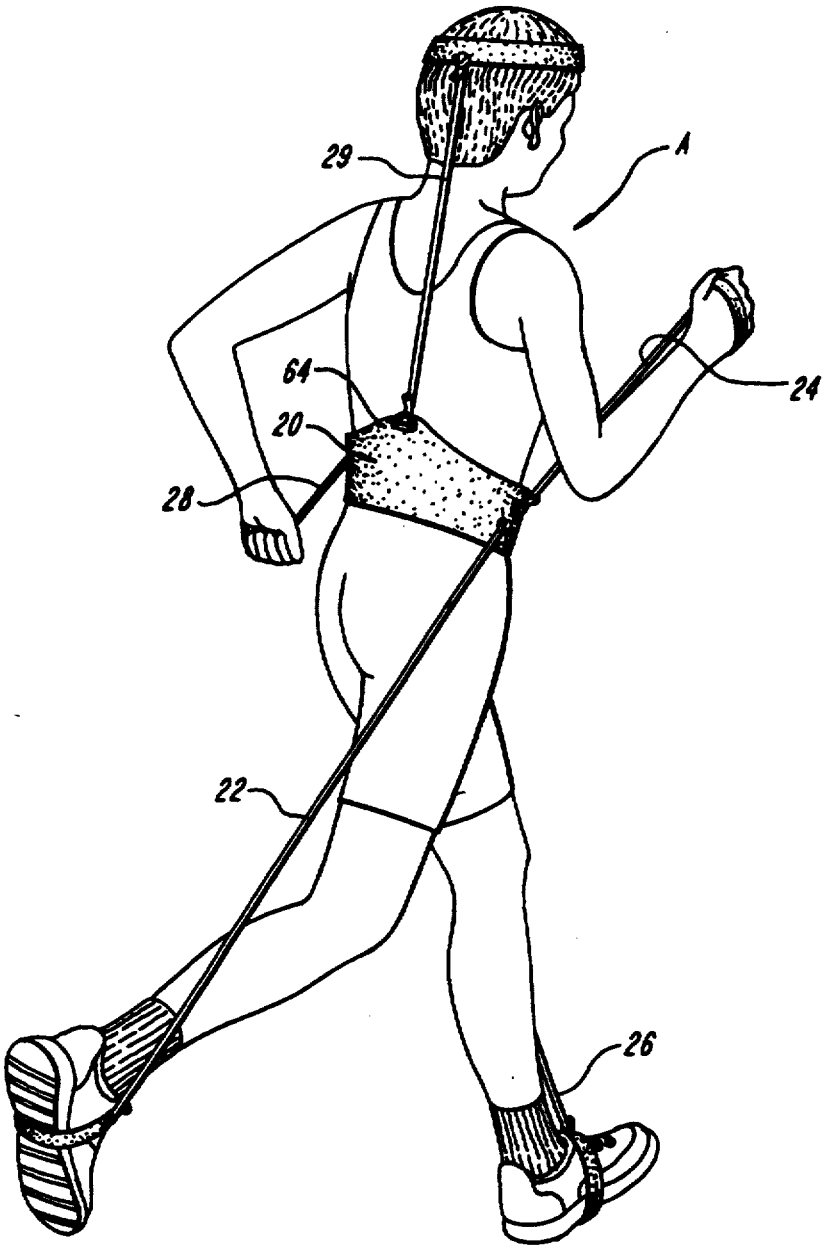
FIG. 1 is a general view of a universal exercise device of the invention as worn by a person, with bands connected to the legs, hands, and head.
Figure 2:
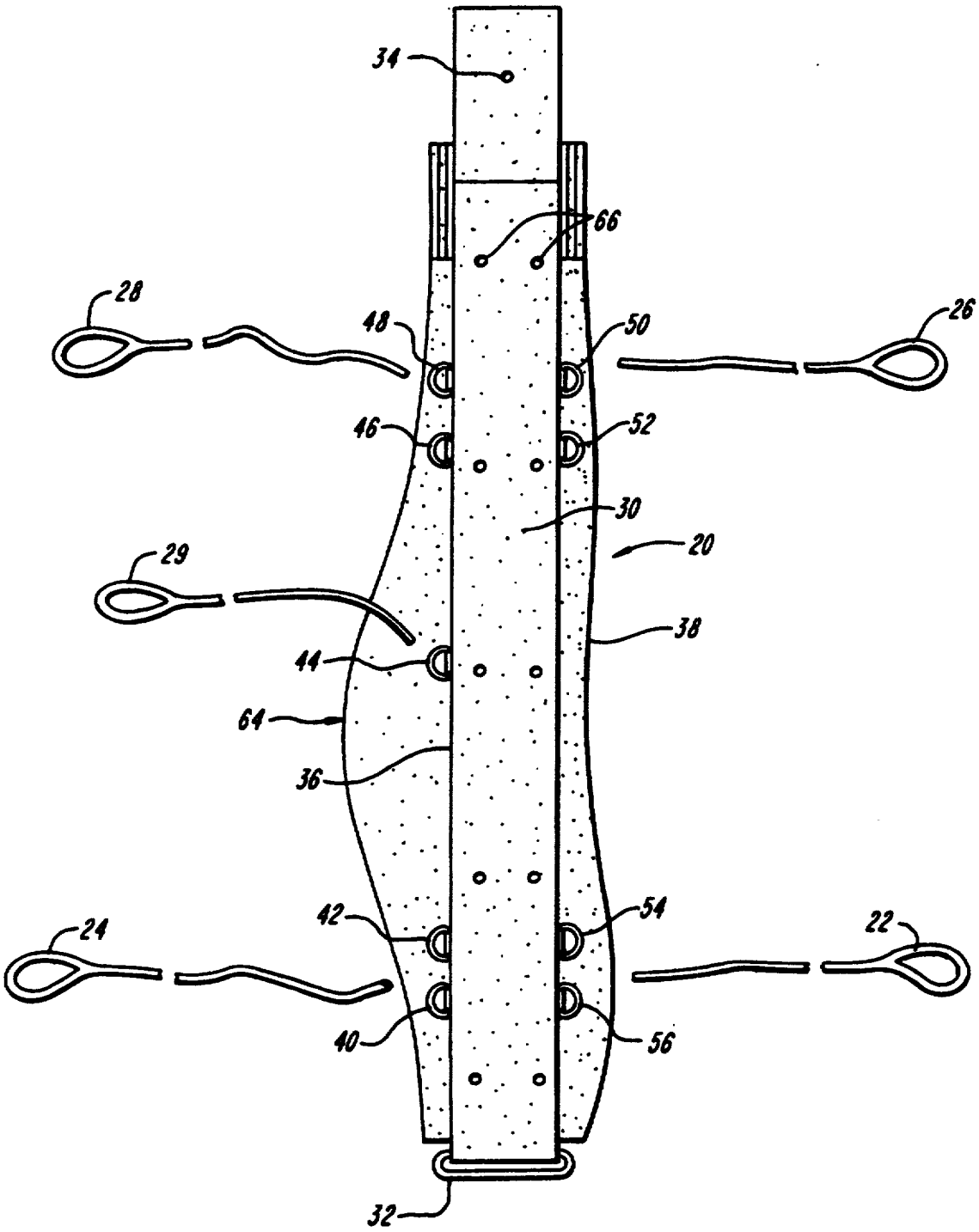
FIG. 2 is a developed view of a device of FIG. 1 from its inner side.

Structural details of the universal exercise device will further be described with reference to FIGS. 2 to 8, wherein FIG. 2 is a developed view of a device of FIG. 1 from its inner side, and FIG. 4 another side of the device.

As shown in FIG. 2, belt portion 20 comprises a panel 30, which is made of an elasticized fabric and/or spandex fabric. An integrated back support 64 is attached to panel 30, goes above and below panel 30, and is located at the user's waist, when the belt is attached to the user's waist. It has a greater width than panel 30 to form the back support. Back support 64 is shaped in accordance with the natural physiological shape of the back of a human body, so as to serve as an injury prevention device. Back-support portion 64 may have a width of up to 30 cm and height at the top of belt 20 up to 10–15 cm.

Figure 4:
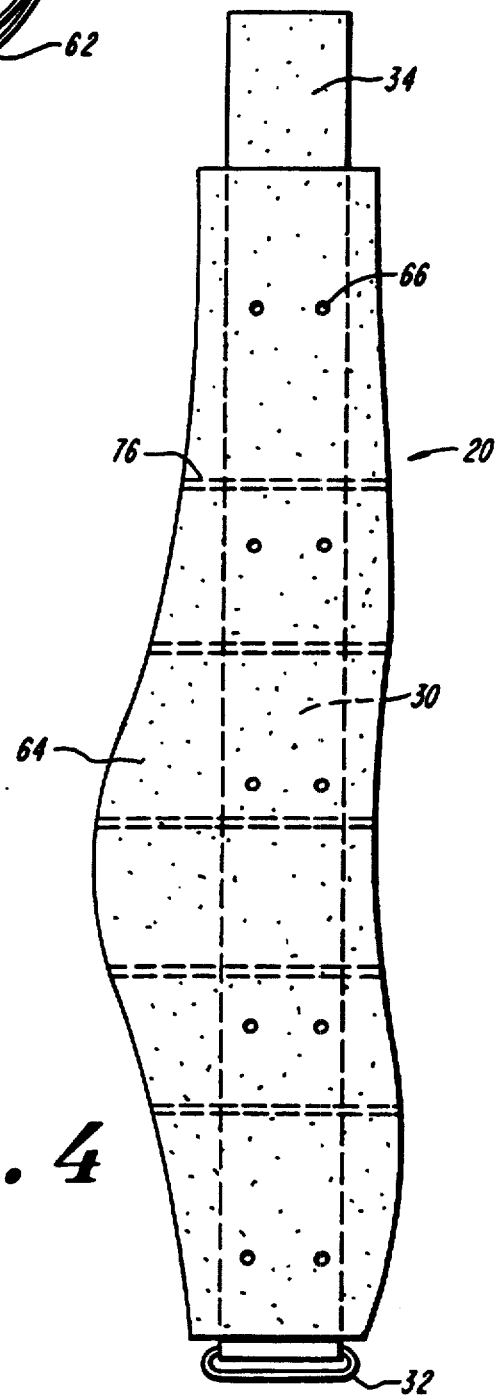
FIG. 4 is a view similar to FIG. 2 from another side of the device.

In the embodiment of FIG. 2, back support portion is made as a part separate from panel 30, and is attached, e.g., by rivets 66 to the face side of panel 30 (FIG. 4.). If necessary, t may be made as an integral part of panel 30. If belt portion 20 consists of two parts, i.e., back support portion 64 and panel 30, rings 40 to 56 may be attached to upper and lower sides 36 and 38 of panel 30 (as shown in FIG. 2), or to back support 64 (such an arrangement is not shown).

Back support 64 is flexible in a longitudinal direction of panel 30 and possesses a certain rigidity in the transverse direction. The transverse rigidity can be achieved by making back support portion 64 thicker than the remaining part of panel 30, e.g., twice thicker than the end portions of the strap, or by providing a reinforcement in the form of inner ribs 76, which are shown by the broken lines in FIG. 4. Ribs 76 may comprise rigid plastic strips embedded or otherwise inserted into the material of panel 30. Ribs 76 may be made of a variety of materials, e.g., of plastic. They may have a thickness of 5 to 10 mm, and are spaced from each other at a distance of 5 to 10 cm. Their heights will be determined by position in back support 64.

As shown in FIG. 4, panel 30 has a rectangular frame 32 in one end, and an attachment element 34 on its other end. This attachment element may comprise a fastening belt which is known under the trademark VELCRO and which consists of opposite pieces of fabric, one with a dense arrangement of tiny nylon hooks and another with a dense nylon pile, that interlock when pressed together. The attachment element can be connected to panel 30, e.g., by sewing, rivetting, or gluing.

Figure 3:
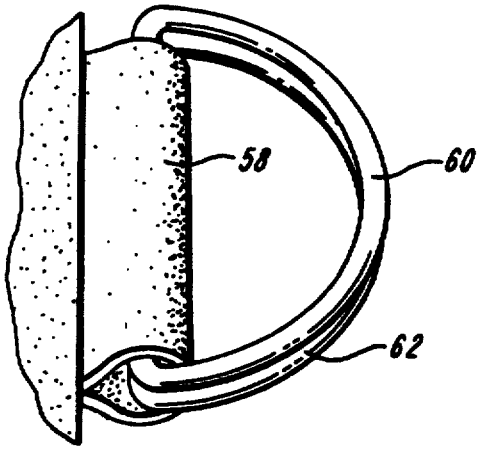
FIG. 3 is a perspective view illustrating the construction of a ring pair for the attachment of interchangeable elastic straps to the belt panel of the device of FIG. 2.

As shown in FIG. 2, upper side 36 and lower side 38 of panel 30 support a plurality of ring pairs 40, 42, 44, 46, 48, 50, 52, 54, and 56. The construction of a ring pair is shown in FIG. 3. FIG. 3 is a perspective view illustrating the construction of a ring pair for the attachment of interchangeable elastic straps 22 to 30 to belt panel 30. The rings can be made of metal or plastic.

In the embodiment shown in FIG. 2, five ring pairs are shown attached to the upper side 36 of panel 30 and four ring pairs are shown attached to lower side 38 of panel 30. The upper attachment points of the rings are in the same vertical line as the lower rings, and provide the anchoring mechanism for elastic straps 22 to 29.

The upper left and right ring pairs 40, 42 and 46, 48 serve for the attachment of elastic straps 24 and 28 for the user's hands, while ring pair 44, which is located in the middle of panel 30, is intended for strap 29 which is attachable to the user's head.

Lower ring pairs 56, 54 and 52, 50 serve for the attachment of elastic straps 22 and 26, respectively attachable to the user's legs.

In FIG. 2, two pairs of the rings which are located at the ends of panel 30 and are spaced apart in the longitudinal direction of the panel are provided for adjustment of the strap attachment points in accordance with the size of the user's waist. It is understood that only one pair of such rings, or more than two pairs of the rings can be provided at each end of strap 30.

Panel 30 may have a length within the range of 50 cm to 125 cm and a thickness of about 0.5 cm. Ring pairs 40 and 56 may be located at a distance of 3 to 10 cm from frame 32, and rings 48 and 50 may be located at a distance of 3 to 10 cm from the end of the attachment element. Since all ring pairs will be identical, only one of them is described with reference to FIG. 3. Each ring pair consists of a ferrule 58 which can be attached to a respective upper side 36 or lower side 38 of belt panel 30, e.g., by sewing, riveting, gluing (not shown). Ring elements 60 and 62 may have a circular or oval shape and be locked inside ferrule 58 so that they can be freely pivoted with respect to ferrule 58 and one another.

Figure 5:
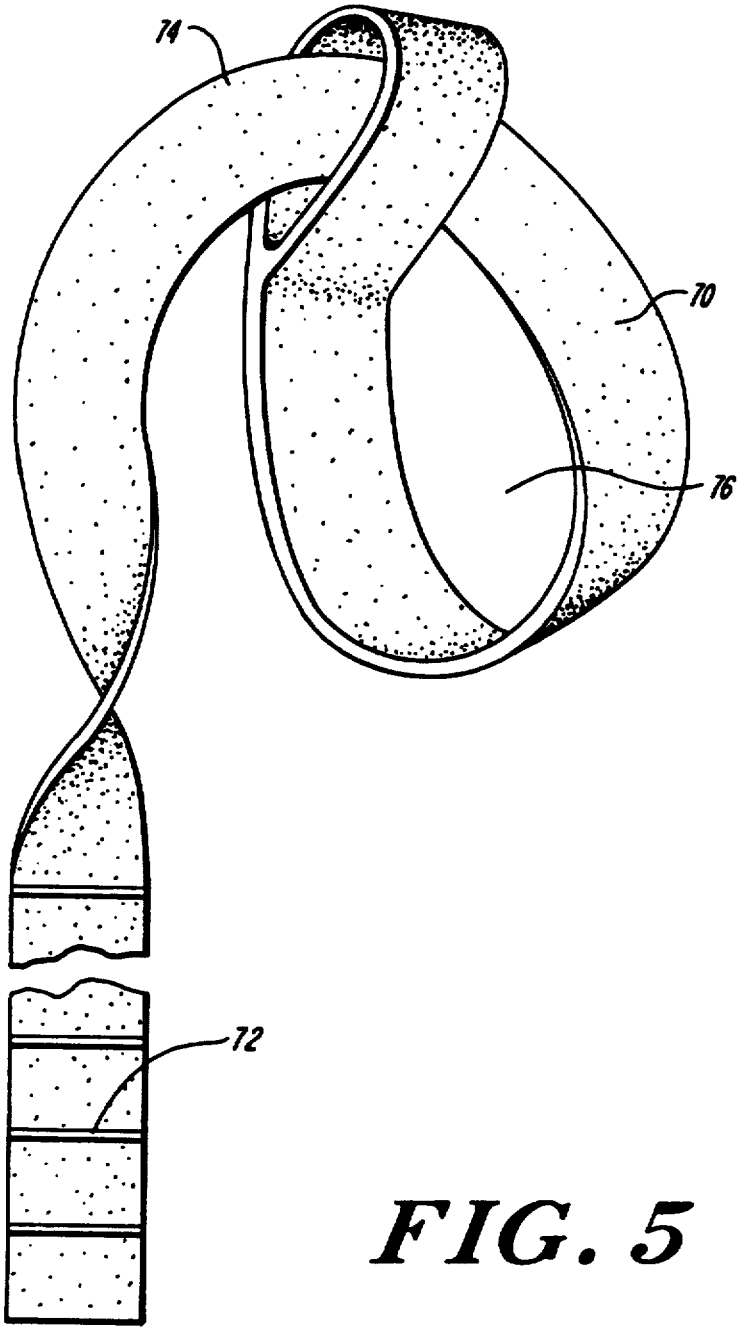
FIG. 5 is a view of an elastic strap with an adjustable loop.
Figure 6:
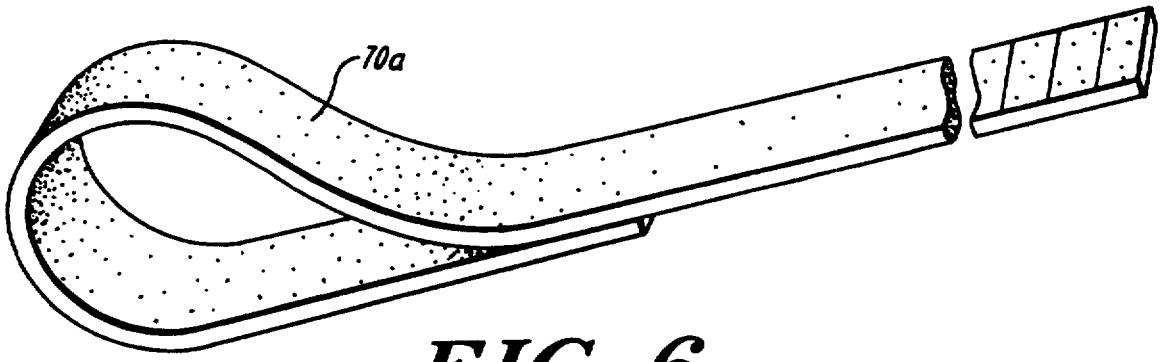
FIG. 6 is a view of an elastic strap with a permanent loop.

An example of an elastic strap is shown in FIG. 5. The strap has a molded loop 74 at one end, and a means for measuring or adjusting the length and tension of the strap in the form of markings 72 on the other end to indicate different degrees of tension on strap 70 when the strap is fastened to the rings by simply looping it up-over-down-inside-out of the rings, allowing the user to control the resistance of each attached band closely and consistently. This provides a consistent and infinite range of tensions to safely suit every user's immediate changing specific needs for strength, comfort and endurance.

As shown in FIG. 5, the end of elastic strap 70 may have a hole 74 for passing the marked end of strap 70 through this hole, to make a loop 76 fully adjustable. The loop is formed by passing strap 70 through hole 74. Hole 74 may be permanent as shown in FIG. 5. Loops 70 or **70*a*** allow the user to simply and automatically place the loop on his or her foot, outside of his or her shoe, on the palm of his or her hand, or on his or her head.

Figure 7:
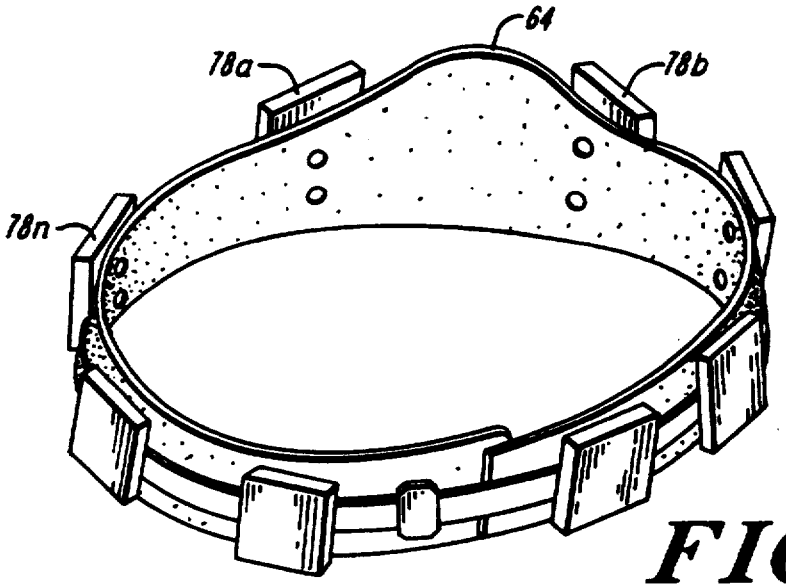
FIG. 7 is a perspective view of a closed belt portion with floating elements attached to its outer surface.

As shown in FIG. 7, which is a perspective view of the belt of FIGS. 2 and 4 in a closed state, the outer surface of belt portion 20 supports a plurality of floating elements **78*a*, 78*b*, . . . 78*n*. These elements may comprise closed-cell foam blocks attached to a continuous attachment strip 68 by applying pressure to them. For attachment purposes, the floating elements should have on their side either the above-described VELCRO hooks or the matching pile, depending on the type of connection elements on the surface of attachment strip 68. With the use of strip 68**, floating elements can be placed anywhere along the belt to give a wide range of buoyant force in the water to perfectly suit the weight and exercise ability of the user.

Figure 8:
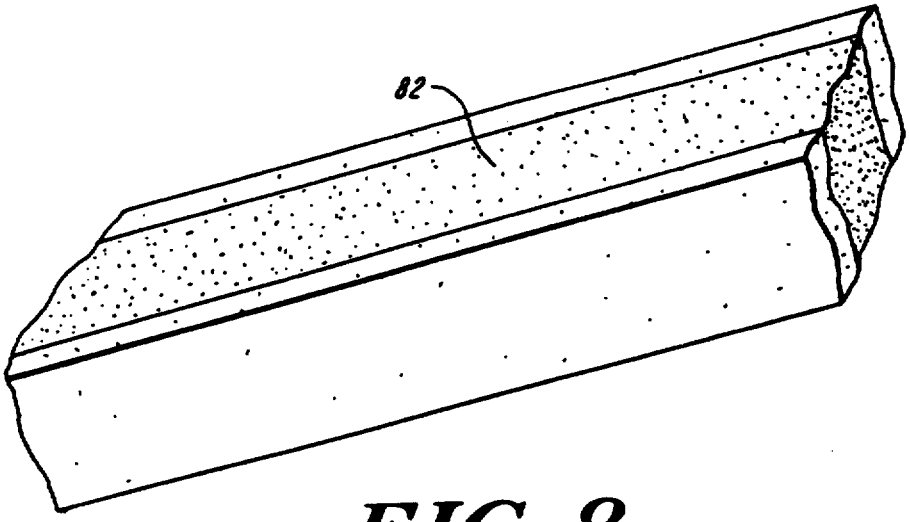
FIG. 8 is a longitudinal sectional view of a portion of a belt panel with a strip-like floating element inside.

FIG. 8 is a longitudinal sectional view of a portion of a hollow belt panel 80 with a strip-like floating element 82 inside the cavity formed in the hollow panel.

Thus, it has been shown that belt portion 20 serves four purposes: first, it is used as the closure point for the belt end when it is first placed on the user; second, it is used for the attachment of elastic straps; third, it is used for supporting or carrying the floating element for buoyancy in water; fourth, it forms a base for the back support.

FIGS. 1-8. OPERATION OF THE UNIVERSAL EXERCISE DEVICE

To exercise, the user simply places belt portion 20 around his/her waist in a comfortable position. He/she then passes the free end of attachment element 34 through frame 32 of belt panel 30, tightens the belt portion, overlaps attachment element 34 over attachment strip 68, and attaches it securely to strip 68 by means of engaging the above-mentioned loops with the matching pile. He/she can now use the belt portion as a means for attaching elastic straps 22 to 30. At the same time, due to the provision of back-support portion 64, belt portion 20 can be used as a physiological back support and a trauma-prevention mechanism.

Next, the user passes the free or non-looped ends of each elastic strap through its respective opening 74, forming a new loop that he/she will place around his/her feet, hands, or head, and pull them comfortably snug. He/she then takes the free end of the strap and passes it through the appropriate pair of rings 60 and 62 on the belt, loops it back over one of the rings and passes it under and through the other ring to securely hold it to the belt, depending on the specific exercise(s) he/she plans to do. He/she lengthens or shortens belt panel 30 to adjust the pressure he/she needs to suit his/her personal exercise goals and physical condition. Similarly, he/she will attach elastic strap 26 around his/her forehead, above his/her ears, and attach this elastic band to the back of his/her head, and then down through belt portion 30. He/she has the option of using any or all of the five bands, depending upon his/her exercise objectives.

If he/she desires to use the exercise device in the water, he/she will attach foam-cell blocks **78*a*, 78*b*, . . . 78*n*, or continuous floating strip 82 (depending on the type of belt portion used) to belt panel 30** by simply pressing the side of the foam block having hooks or pile against the complementary attachment elements of the belt portion. The foam-cell blocks or strip will impart buoyancy to the user. This is also an optional use of the device at the user's preference.

Once he/she has attached the belt and feels comfortable with the tensions and adjustments, he/she then begins a series of complementary and specially designed exercises that cover a full range of aerobic, strength development, and balance functions, and are provided according to a range of proficiency, from beginning (simple) to advanced (complex). These exercises involve the use of the belt for standing, walking, running, jumping, sitting, lying down, stretching, aerobics, and other sport-specific exercises.

FIG. 9—EXAMPLE OF LAND EXERCISE USE (AEROBIC)—"JUMPING JACKS"

Figure 9:
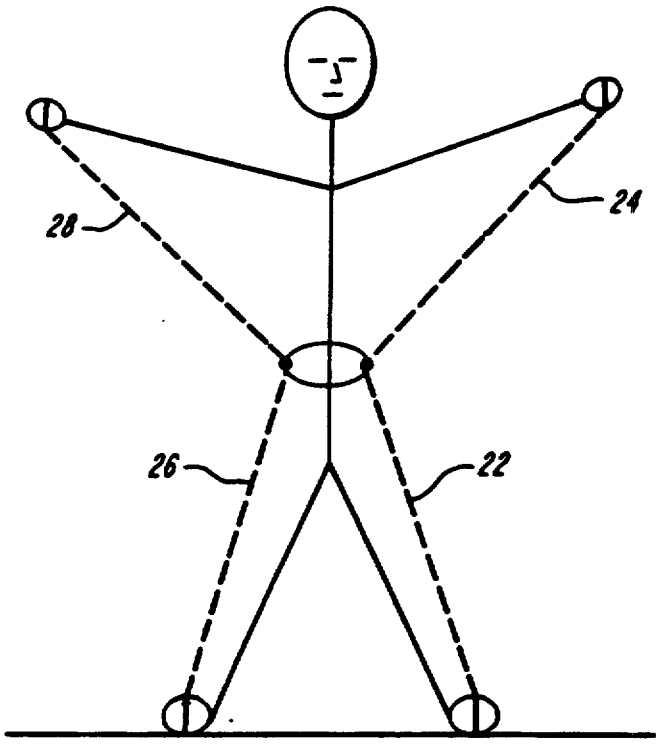
FIG. 9 illustrates land use of the exercise device.

FIG. 9 is a schematic view illustrating aerobic exercises performed on the land: broken lines show the elastic straps.

Starting position: stand erect, feet together, hands by sides. Action: keeping arms straight, extend and swing them sidewise in an arc directly over your head. Simultaneously, jump up, moving feet apart to the side, and land on toes. Without stopping, return arms and legs to the starting position. Repeat movement.

This exercise develops cardiovascular conditioning, strengthens lower and upper extremities, as well as improves coordination (develops the above-mentioned group of muscles). Repeat 10 jumps×3 times (20-30 second break between sets of jumps).

FIG. 10—EXAMPLE OF AQUATIC EXERCISE (BELT WITH BUOYANCY CLIP)

Figure 10:
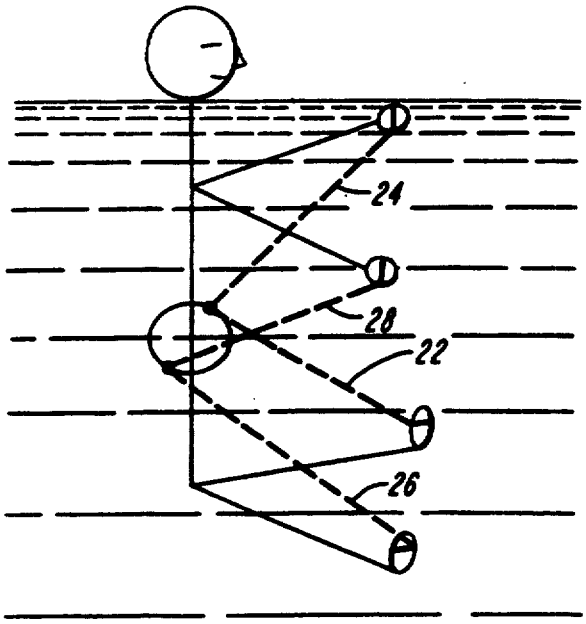
FIG. 10 is an example of aquatic use of the exercise device.

FIG. 10 is a schematic view illustrating an example of an exercise performed in the water: the broken lines show elastic straps.

Breaststroke in vertical/horizontal position

Starting position: stand erect in the water, feet together, hands by sides.

Action: bend both knees up to perpendicular position. Develops coordination, balance, strength (due to water and tubing resistance), pelvis stability. Involves the above-mentioned muscle groups plus abductors and abductors, abdominal, and back muscles.

Repeat 1 minute forward, 1 minute (the same motion) backward, 3 times.

Tension in the elastic straps is adjusted by the user, if desired.

All exercises help to control weight by burning calories.

SUMMARY, RAMIFICATIONS, AND SCOPE

Thus, it has been shown that we have provided a universal exercise machine that ensures unrestricted freedom of movement and flexibility; allows the user's movement in any direction; can be used when the user is lying down, sitting, standing, walking, jogging, running, jumping, swimming, water walking and running (in zero gravity environment), and exercising in any kind of sport activity; is free of a potentially dangerous attachments; is physiologically advantageous for the user's entire body; provides an integrated back support; is simple in construction; is, moreover, simple and inexpensive to manufacture, easy to adjust, highly portable, and applicable to various exercises both on land and in the water.

Although the universal exercise machine has been shown and described in the form of one specific embodiment, its parts, materials, and configurations are given only as examples, and many other modifications of the machine are possible. For example, the elastic straps can be fixed to the belt portion through holes punched in the belt panel; an inflatable hollow belt panel can be used as a floating means for imparting buoyancy; more or less than five elastic straps can be connected to the belt portion; buttons or a conventional belt buckle can be used instead of frictionally engageable tiny hooks and pile. The belt portion alone, i.e., without the elastic straps, can be used merely as a back support by people having a back problem. The machine is suitable for a great variety of exercises, rather than being limited to those two that have been shown as an example only.

Therefore, the scope of the invention should be determined, not by the examples given, but by the appended claims and their legal equivalents.

I claim:

1. A universal exercise device comprising:

a belt portion having means for attaching to the waist of a device's user;

a plurality of elastic straps, each having means for attaching to a body part of the user at one end, and means for measuring the length and tension of said elastic strap obtained after the attachment to said belt portion at the other end;

a plurality of means on said belt portion for the attachment of a selected number of said plurality of said elastic straps;

integrated back support means in said belt portion for supporting the back of said user, said integrated back support portion being located in an intermediate portion of said belt portion so that, when said belt portion is fixed to the user's waist, said back portion is located behind the user's back; and floating means on said belt portion, for imparting a buoyancy to said user for exercising in the water;

said integrated back support means comprising an intermediate part of said belt portion, which has a width and a rigidity greater than the width and the rigidity at the ends of said belt portion;

said belt portion having an inner side, an outer side, an upper longitudinal edge and a lower longitudinal edge, said outer side having means for the attachment of said floating means;

said means for the attachment of said floating means comprising a plurality of tiny hooks or pile, on said outer side of said belt portion and pile or a plurality of hooks on said floating means;

said means for attaching to the waist of the device's user comprises pile or a plurality of hooks for attachment to said plurality of hooks or said pile on said outer side of said belt portion;

said floating means comprise a plurality of closed-cell foam blocks;

said means for measuring the length and tension of said elastic strap comprise markings on one end of said elastic strap;

said means for attaching to a body part comprise a loop formed on the end of said elastic strap opposite to said one end;

said end of said elastic strap opposite to said one end has a hole, and said loop is formed by passing said one end through said hole.

2. The universal exercise device of claim 1, wherein said upper longitudinal side supports at least five of said plurality of means for the attachment of said elastic straps, first means of said plurality being located at one end of said belt portion, second means of said plurality being located at the other end of said belt portion, and third means of said plurality being located in the middle between said first means and said second means; said lower longitudinal side supporting at least fourth means of said plurality at one end of said belt portion, and fifth means of said plurality at the other end of said belt portion.

3. The universal exercise device of claim 2, wherein each of said plurality of means on said belt portion for the attachment of a selected number of said plurality of said elastic straps comprises a ferrule attached to said upper longitudinal side of said belt portion and to said lower longitudinal side of belt portion, and a pair of rings passed through said ferrule, freely pivotable with respect to said ferrule and with respect to each other.

4. A universal exercise device comprising:

a belt portion having means for attaching to the waist of a device's user;

a plurality of elastic straps, each having means for attaching to a body part of the user at one end, and means for measuring the length and tension of said elastic strap obtained after the attachment to said belt portion at the other end;

a plurality of means on said belt portion for the attachment of a selected number of said plurality of said elastic straps;

integrated back support means in said belt portion for supporting the back of said user, said integrated back support portion being located in an intermediate portion of said belt portion so that, when said belt portion is fixed to the user's waist, said back portion is located behind the user's back; and floating means in said belt portion, for imparting a buoyancy to said user for exercising in the water;

said integrated back support means comprising an intermediate part of said belt portion, which has a width and a rigidity greater than the width and the rigidity at the ends of said belt portion;

said belt portion having an inner side, an outer side, an upper longitudinal edge and a lower longitudinal edge;

said means for attaching to the waist of the device's user comprises pile or a plurality of hooks for attachment to said plurality of hooks or said pile on said outer side of said belt portion;

said floating means comprise a plurality of closed-cell foam blocks;

said means for measuring the length and tension of said elastic strap comprise markings on one end of said elastic strap;

said means for attaching to a body part comprise a loop formed on the end of said elastic strap opposite to said one end;

said end of said elastic strap opposite to said one end has a hole, and said loop is formed by passing said one end through said hole;

said belt portion having cavity and said floating means being inserted into said cavity.

5. The universal exercise device of claim 4, wherein said upper longitudinal side supports at least five of said plurality of means for the attachment of said elastic straps, first means of said plurality being located at one end of said belt portion, second means of said plurality being located at the other end of said belt portion, and third means of said plurality being located in the middle between said first means and said second means; said lower longitudinal side supporting at least fourth means of said plurality at one end of said belt portion, and fifth means of said plurality at the other end of said belt portion.

6. The universal exercise device of claim 5, wherein each of said plurality of means on said belt portion for the attachment of a selected number of said plurality of said elastic straps comprises a ferrule attached to said upper longitudinal side of said belt portion and to said lower longitudinal side of belt portion, and a pair of rings passed through said ferrule, freely pivotable with respect to said ferrule and with respect to each other.

* * * * *